US005655801A

United States Patent [19]

Casey

[11] Patent Number: 5,655,801

[45] Date of Patent: Aug. 12, 1997

[54] GATE LATCH

[76] Inventor: Michael Casey, 71 Westchester Dr., Rocky Point, N.Y. 11778

[21] Appl. No.: 531,421

[22] Filed: Sep. 21, 1995

[51] Int. Cl.[6] ..... E05C 3/16

[52] U.S. Cl. ..... 292/210; 292/236; 292/348

[58] Field of Search ..... 292/210, 202, 292/203, DIG. 30, 67, 348, 350, 230, 231, 233, 236, 195

[56] References Cited

U.S. PATENT DOCUMENTS

| | | | |
|---|---|---|---|
| 1,024,371 | 4/1912 | Soley | 70/346 |
| 1,235,560 | 8/1917 | Deloatch | 292/236 |
| 1,385,125 | 7/1921 | Fraser | 292/350 |
| 1,389,339 | 8/1921 | Anderson | 292/229 |
| 1,405,695 | 2/1922 | Teich | 292/350 |
| 1,681,850 | 8/1928 | Getchell | 292/230 |
| 2,094,547 | 9/1937 | McCulloch et al. | 292/202 |
| 2,683,049 | 6/1954 | Van Der Spek | 292/207 |
| 2,801,868 | 8/1957 | Carson | 292/202 |
| 3,266,831 | 8/1966 | Banse | 292/133 |
| 3,378,289 | 4/1968 | Beckman et al. | 292/31 |
| 3,433,518 | 3/1969 | Foltz | 292/238 |
| 5,078,438 | 1/1992 | Bieganski | 292/235 |
| 5,116,090 | 5/1992 | Nichandros | 292/236 |
| 5,498,041 | 3/1996 | Bezzerides et al. | 292/225 |

*Primary Examiner*—Steven N. Meyers
*Assistant Examiner*—Donald J. Lecher
*Attorney, Agent, or Firm*—Marvin Feldman

[57] ABSTRACT

A gate latch has a handle with a cojoined adjustably sized elongated rigid metal rod, which rod is rotatably disposed in sleeves frictionally retained within a drilled hole in a fixed post of a fence. The rod is formed with a plurality of spaced parallel threaded through holes. The handle has a transverse hole and is mounted to the rod by a bolt passing through the handle hole and one of the rod holes disposed at the end of the rod on the outside of the post. The rod is operably connected to a spring return locking plate for locking a gate rod which gate rod is fixedly mounted to an openable gate. The user first drills the post hole to receive the elongated rod slidably disposed in the sleeves, and then cuts the elongated rod to a length to accommodate the thickness of the post, and then attaches the handle at the hole adjacent the cut end of the elongated rod. The user in operating the gate latch rotates the handle downwardly which in turn rotates the elongated rod in the post hole. This rotation extends the spring and rotates the locking plate to unlock the gate rod. The user then pushes the gate open to free the gate rod, and finally releases the handle. When the gate is being closed, the gate rod slides on a cam surface on the locking plate and then snaps, by the spring action, into the locked position. The gate cannot be unlocked unless the handle is downwardly rotated.

16 Claims, 3 Drawing Sheets 20
13
22
10
3
3
12
15
14
16
20c
20d
20
20b
21b
21a
21
19
22a
19
22
19
24
29
23
25
27
26
28
52
33
34
32
31
41
39
11
51
50
35
36
37
38
40
30
44
42
44
43
44
46
45
47
15
66
65
14
68
67
16
57
59
62
61
64
58
56
60
56
55
57

GATE LATCH

BACKGROUND OF THE INVENTION

1. Field of the Invention

This invention relates to latches for locking and unlocking a gate.

2. Discussion of the Prior Art

Heretofore it was known to provide a gate latch which was disposed on the inside of a movable gate adjacent a fixed post. To unlock the gate, the user had to either reach over the gate from the outside to the inside of the gate to access the latch mechanism or attach a string or flexible member to the latch mechanism and run the string from the inside over or around the fence to the outside the fence and then pull the string to actuate the latch mechanism to unlock the gate. The string or flexible member often became entangled, disconnected or broken in repeated use. These prior art latches did not positively accommodate differently sized fences or posts, and were readily subject to entanglement or breakage in use. Typical prior art flexible member actuated gate latch constructions are shown in U.S. Pat. No. 1,235,560 granted Aug. 7, 1917 to Deloatch, U.S. Pat. No. 3,433,518 granted Mar. 18, 1969 to Foltz, U.S. Pat. No. 3,266,831 granted Aug. 16, 1966 to Banse, U.S. Pat. No. 4,305,611 granted Dec. 15, 1981 to Robins, U.S. Pat. No. 4,993,759 granted Feb. 19, 1991 to Thomas and U.S. Pat. No. 5,078,438 granted Jan. 7, 1992 to Bieganski.

The art desired a durable and yet readily installable gate latch that would, in a positive manner, accommodate differently sized gates in installation and use.

SUMMARY OF THE INVENTION

A gate latch is formed with a handle which is operatively disposed on the outside of a fixed post or fence. The handle is removably mounted on one end of an elongated rigid metal rod. Sleeves or bushings are slidably disposed on the rod and are retained within a hole drilled in the fence to receive the rod and sleeve assembly. The elongated rod is formed with a plurality of spaced, parallel threaded through holes. The rod is slidably rotatably received in a horizontal through hole drilled in the fence post. The user cuts the elongated rod to extend just beyond the outside of the fence post so that at least one of rod holes disposed outside the fence post. The handle is formed with a transverse similarly sized hole to that of the rod through holes. A bolt or screw connects the handle to the rod by passing through the handle transverse hole and into the rod hole adjacent the cut end of the rod. In this manner of construction, the latch is specifically sized for the particular size fence post. The other end of the rod is operatively interconnected to a spring biased locking plate which is rotatably mounted to a latch mechanism fixed to the inside of the fence post for locking a gate rod or member which is fixedly mounted to a movable gate immediately adjacent the post the locked gate position. The user rotates the handle downwardly so that the handle causes the elongated rod to rotate in the drilled post hole, which in turn causes the locking plate to rotate to extend the spring. With rotation of the locking plate, the gate rod is unblocked so that the gate can be pushed open. The handle is then released, and with the spring action the handle is returned to its original position. To lock the gate, the user pulls the gate closed with the gate rod riding the locking plate cam surface, and with the spring action, the gate rod snaps back to the locked position. The handle likewise moves with the gate rod cam surface movement to its original position.

DESCRIPTION OF THE PREFERRED EMBODIMENT

Figures 1, 2:
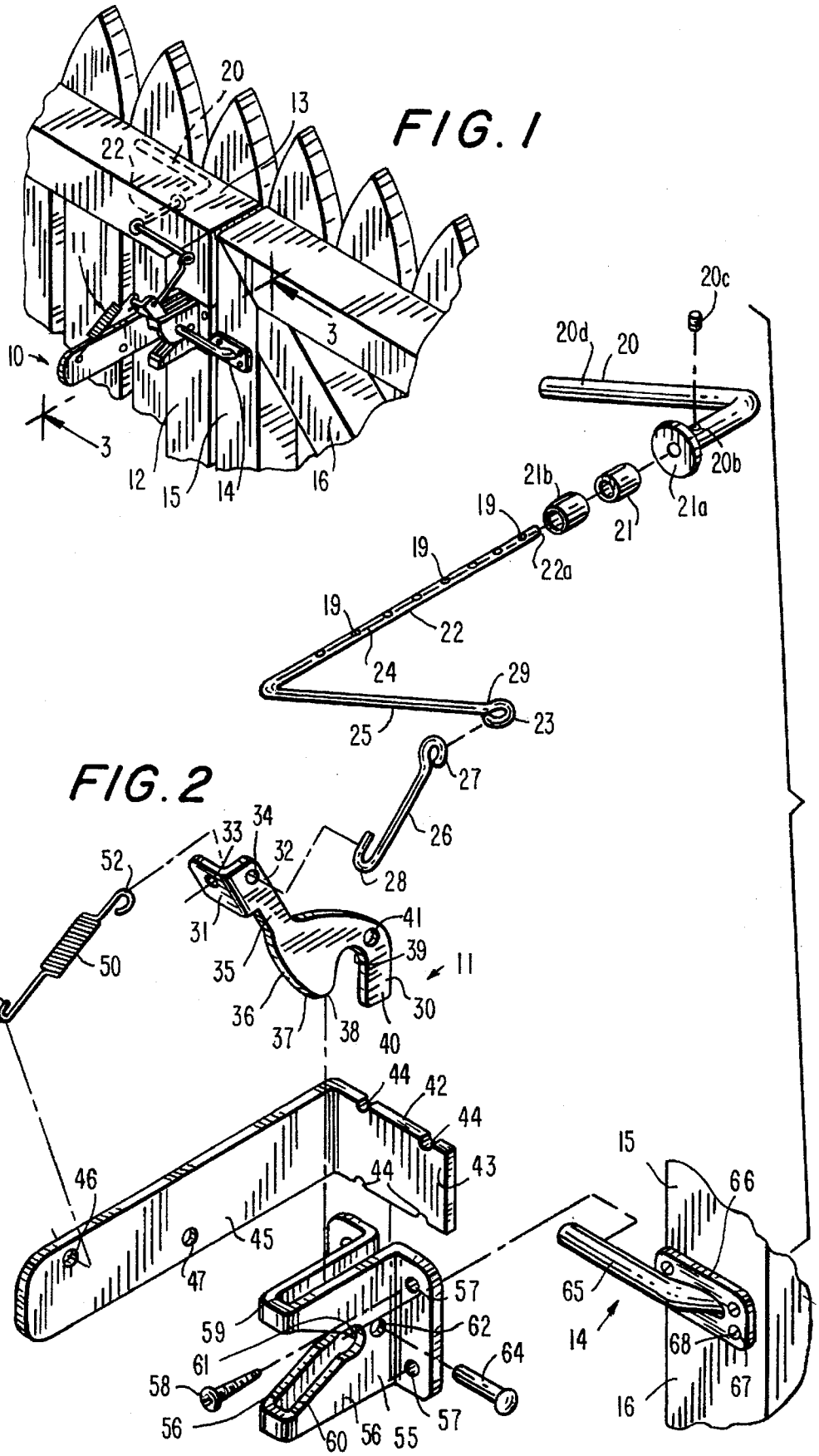
FIG. 1 is a fragmentary perspective view of the gate latch of the present invention shown in the locked position mounted to the inside of a movable gate and fixed post or fence.
FIG. 2 is an enlarged exploded view of the gate latch.

Referring to the FIGS. there is shown the gate latch of the present invention generally referred to as 10. Gate latch 10, in broad terms, comprises a latch mechanism or assembly 11 mounted to the inside 12 of a fixed post or fence 13, and a gate rod assembly 14 fixedly mounted to the inside 15 of movable or hinged gate 16. Assemblies 11 and 14 are mounted in aligned adjacent positions for cooperation, as will be further explained hereinafter. Post 13 is formed with a through hole 17 which extends from the fence outside 18 to the inside 12, for purposes hereinafter appearing. The user drills hole 17 in mounting the gate latch assembly 11 (FIG. 2) to accommodate the particularly sized post 13. That is, hole 17 is sized to receive the latch assembly 11, as is further explained herein.

Latch assembly 11 comprises an L-shaped handle 20 having a cylindrical axial recess **20*a* with a transverse hole 20*b* intersecting recess 20*a*. Handle 20 is also formed with plate 21*a* having a hole coincident with recess 20*a*. An elongated L-shaped rigid metal rod 22 is slidably rotatably disposed in drilled hole 17 of post 13. It is important to note that rod 22 is formed with a plurality of similarly sized, parallel, threaded through holes 19. Holes 19 are comparably sized to handle transverse hole 20*b*. Annular bushings or sleeves 21 and 21*b* are slidably mounted on L-shaped elongated metal rod 22. Hole 17 is sized so that bushings 21 and 21*b* are received and frictionally retained in hole 17. Handle internal cylindrical recess 20*a* is sized to receive cut end 22*a* of rod 22. That is, the user cuts rod 22 to form cut end 22*a* so that at least one hole 19 is disposed outside of fence 13 for the purpose of mounting handle 20. A screw or bolt 20*c* fixedly holds handle 20 to rod 22**.

Figure 4:
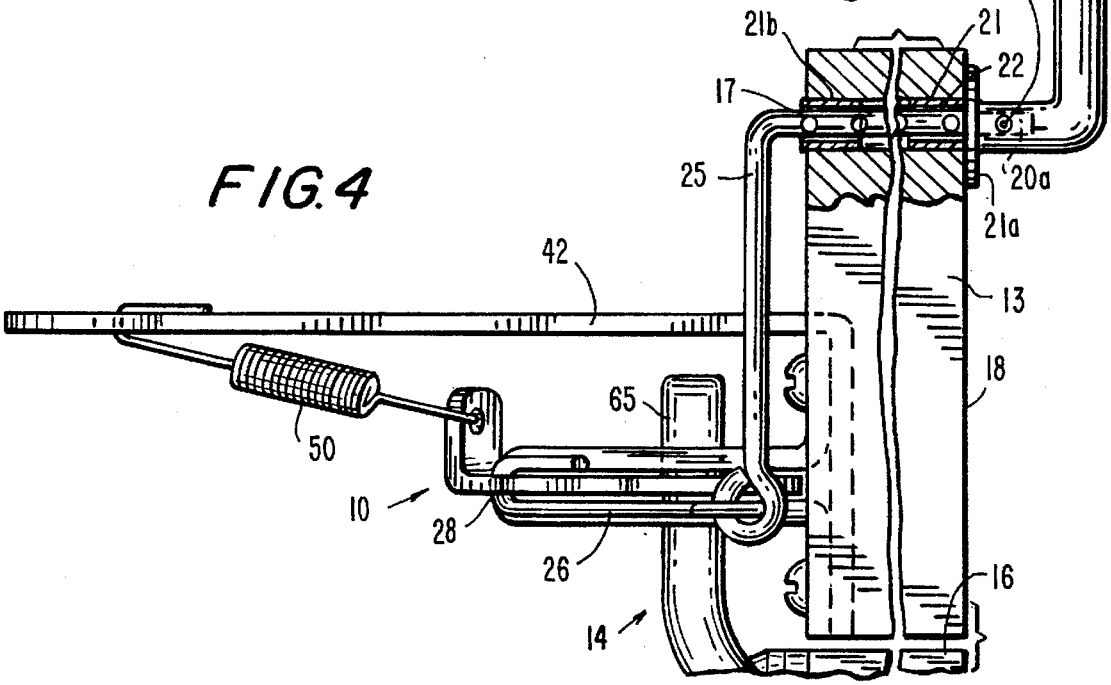
FIG. 4 is a sectional view taken along line 4—4 of FIG. 3.

Rod 22 has an eye 23 formed at its oppositely disposed end 29. Rod 22 comprises portion 24 and portion 25 which portions form an L-shape. Portion 24 is rotatably mounted in bushings 21 and **21*b* fence post hole 17, while portion 25 is disposed on the inside 12 of the fence 13. In this manner, rod portion 25 and the handle grip end portion 20*d* are in parallel disposition (FIG. 4**).

The latch unlocking mechanism includes a hook piece 26 formed at one end with eye 27 which is hooked or engaged in eye 23, and formed with hook 28 at its other end. A plate 30 is formed with right angled portions 31 and 32, each having respective holes 33 and 34. Portion 32 is formed with depending portion 35 which is formed with a cam surface 36 which comprises the following contiguous surfaces; curved surface 37, rounded corner surface 38, and a curved recess surface or seat 39. A depending flange 40 with hole 41 completes the plate 30 construction. An L-bracket 42 has one portion 43 of the L being mounted as at cut-outs 44 to the inside 12 of the fence, while the other portion 45 extends perpendicularly inwardly from the fence. Portion 45 is formed with holes 46 and 47. A spring 50, at one end, is formed with hook 51 which is hooked into hole 46, and at its opposite end is formed with hook 52 which is hooked into hole 33. A mounting bracket 55 is formed with opposed plates 46 having like spaced holes 57 for receiving screws 58 (typical) for co-mounting brackets 55 and 42 to fence inside 12. Bracket 55 is formed with a U-flange 59 forming a V-groove 60 having a part-cylindrical recess surface or seat 61. Bracket 55 has opposed co-incident holes 62 which are sized for receiving pin 64. Pin 64 passes through holes 62 and hole 41 of locking plate 30 so that plate 30 is rotatable about pin 64.

Figure 3:
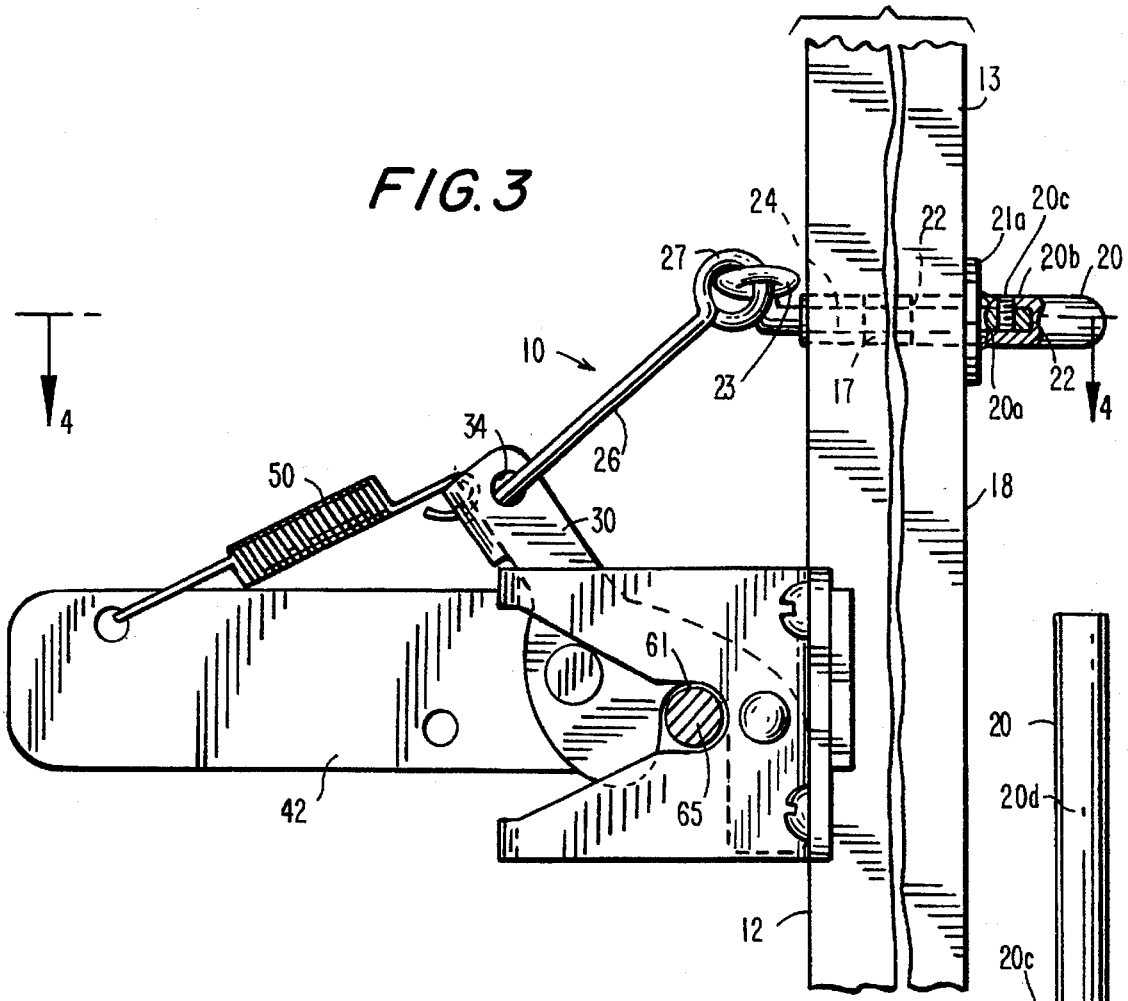
FIG. 3 is an enlarged sectional side view taken along line 3—3 of FIG. 1.

Gate rod assembly 14 is formed of a gate rod 65 formed with bracket portion 16 having mounting holes 67 and screws 68 for mounting assembly 14 to the inside 15 of gate 16. Gate 16 is hinged (not shown) for inward movement of the gate in the conventional manner. Assembly 14 is mounted so that rod 65 is seated in recess 61 with the gate fully closed adjacent the post, as best shown in FIG. 3.

Figure 5:
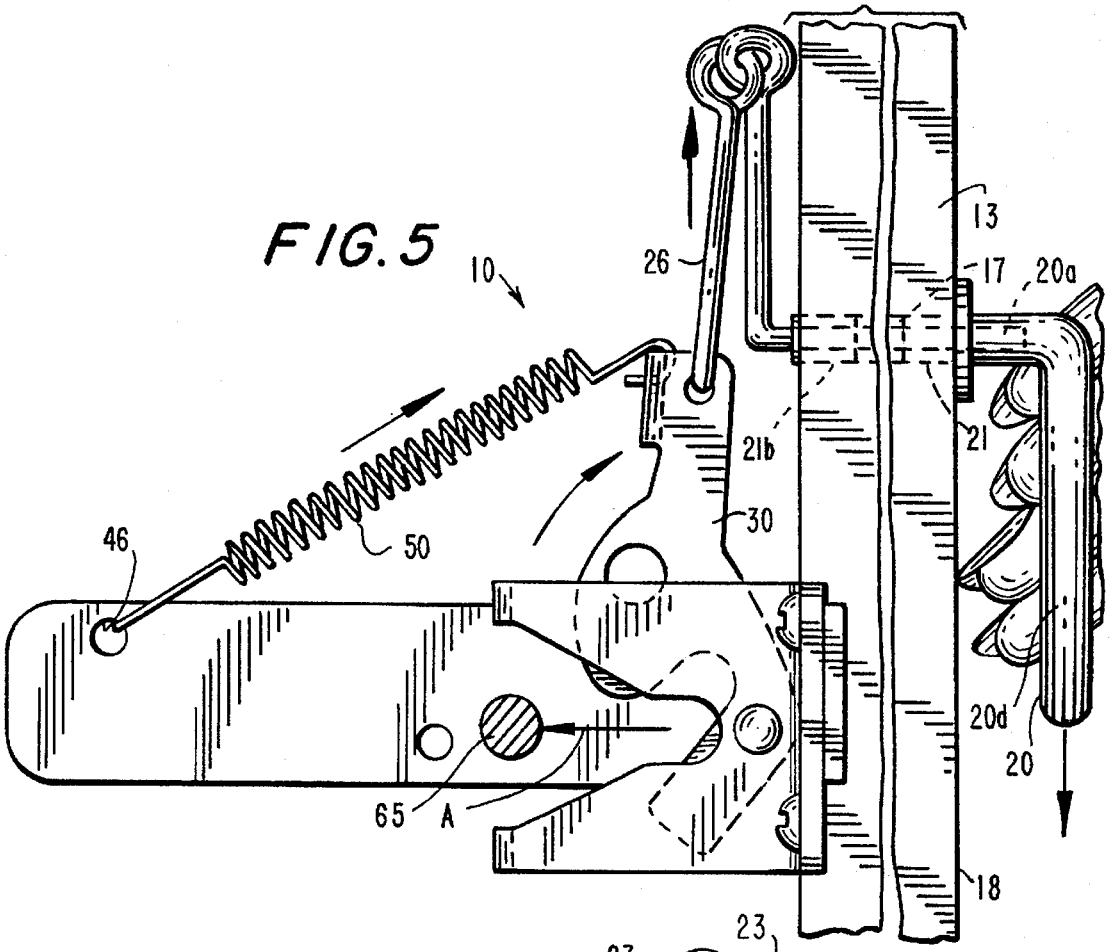
FIG. 5 is a side view as in FIG. 3 but shown in the unlocked position.

By the aforesaid manner of construction, the user first drills hole 17 to slidably accommodate rod 22 in sleeves or bushings 21 and **21*b*. Sleeves 21 and 21*b* are frictionally retained in hole 17. The user then cuts rod 22 to form cut end 22*a* to accommodate the particular size or thickness of fence or post 13, so that at least one rod hole 19 is exposed outwardly outside the post and outwardly beyond bearing sleeve 21, so that handle 20 is attached at cut end 22*a* of rod 22 by bolt 20*c*. The user may cut or saw the metal rod 22 to form end 22*a* by means well known in the art. The user fixedly bolts or mounts the latch mechanism to the post and mounts the gate rod assembly to the gate in the well known manner. In operation, the user grips portion 20*d* and turns handle 20 downwardly causing rod portion 24 to rotate within bushings 21 and 21*b* within drilled fence hole 17. This rotation in turn causes rod portion 25 to rotate upwardly. This upward movement of rod portion 25 causes locking plate 30 to be pulled to a position adjacent the inside of the fence, with resultant extension of spring 50, as best shown in FIG. 5. Plate 30 rotates about pin 64 so that plate surfaces 27 and 24 are moved away from gate rod 65. Gate rod 65 is thus freed from locking plate 30. The user may then push the gate open inwardly, with rod 65 in turn moving in the direction of arrow A, as shown in FIG. 5. The user, after the gate is opened, releases the handle which by spring 50 action returns to the position of FIGS. 3–4, but without gate rod 65** locked in place.

Figure 6:
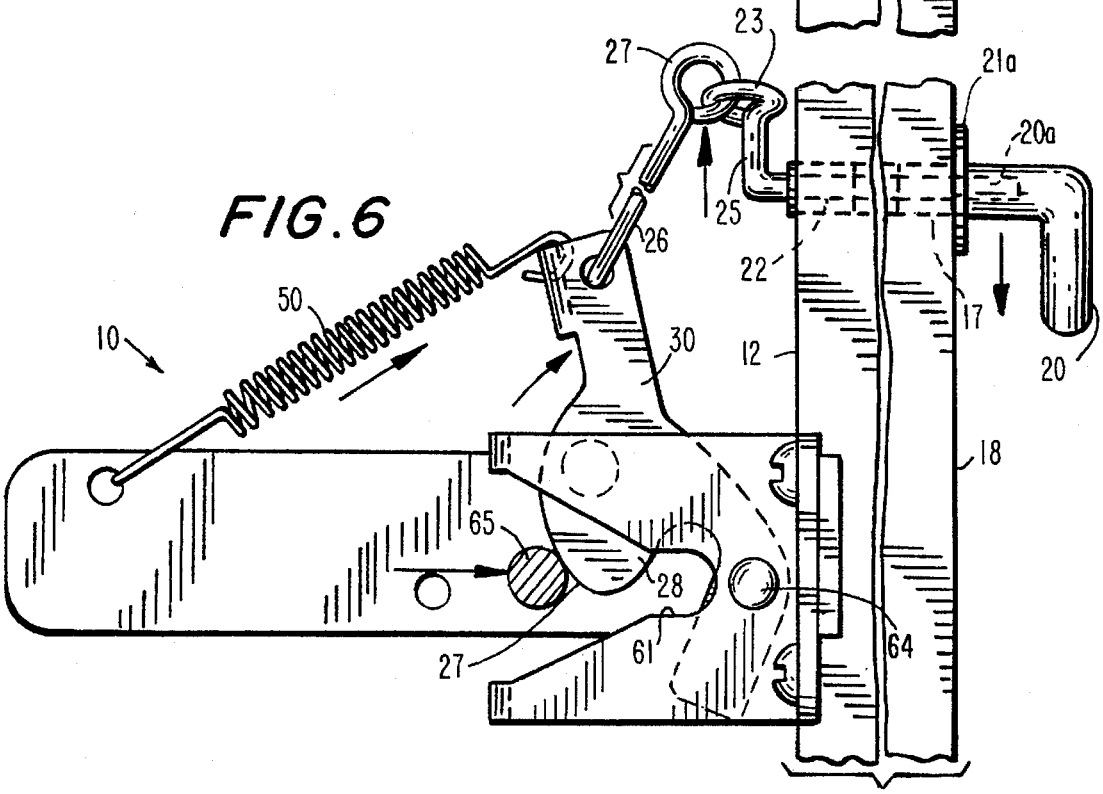
FIG. 6 is a side view as in FIG. 5 but shown with the gate rod engaged for return to the locked position.

To relock the gate, the gate is pulled closed. And as best shown in FIG. 6, rod 65 contacts and rides cam surfaces 37 and 38 to cause spring 50 to partially extend and retract, and when rod 65 is fully seated in recess or seat 61, spring 50 is fully retracted and handle snaps back to the original position as shown in FIGS. 3 and 4.

Various modifications may be made within the spirit and scope of the invention. By way example, the handle transverse hole **20*b* may be threaded or as previously described the rod through holes 19 may be threaded to receive screw or bolt 20*c* for attaching handle 20. Plate 21*a* may be formed as part of the spacer or bushing 21** in an alternate embodiment.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What I claim is:

1. A gate latch comprising, latch means for locking a gate, means for mounting said latch means to a fixedly disposed post, rod means for engaging said latch means, means for mounting the rod means on a gate movably disposed with respect to said post, said latch means comprising means for slidably receiving said rod means, so that with movement of the gate towards the post the rod means is slidably received and locked in the latch means, means for unlocking the rod means from the latch means, said means for unlocking the rod means comprising elongated rod means for actuating unlocking of the rod means, and means for rotatably mounting said elongated rod means with respect to said post, said elongated rod means having oppositely disposed ends, said means for unlocking the rod means being operably disposed at one of said elongated rod means ends, and means for adjusting the length of the elongated rod means to fit the post, said means for unlocking the rod means further comprising spring means for biasing to a locked position with the rod means engaged in said latch means, and plate means for operably interconnecting said elongated rod means with said spring means, means for fixedly mounting said plate means to the post, said spring means being operably disposed between said plate means and said one end of said elongated rod means, and said means for adjusting the length of the elongated rod means being disposed at said other end of said elongated rod means, handle means for actuating said means for unlocking the rod means, and means for mounting said handle means to the other end of the elongated rod means at an adjusted length of the elongated rod means, whereby with movement of the handle means, the elongated rod means rotates and in turn moves the plate means to extend the spring means so that the rod means is unlocked from the latch means to permit the gate to be opened, and with the gate opened the handle means is released and the spring means then bias returns the plate means and latch means to the locked position but without the rod means engaged in the latch means, and the spring means is then unbiased.

2. The gate latch of claim 1, said elongated rod means comprising a rigid construction, and said means for adjusting the length of the elongated rod means comprising a plurality of spaced holes formed in the elongated rod means.

3. The gate latch of claim 1, said means for mounting said handle means further comprising means for disconnectably connecting said handle means to the said other end of the elongated rod means.

4. The gate latch of claim 1, further comprising, in combination, a post, said post being formed with a drilled through hole sized to receive the elongated rod means, and sleeve means for rotatably mounting said elongated rod means in said post hole.

5. The gate latch of claim 4, said unlocking means further comprising spring means, and plate means interconnecting said elongated rod means with said spring means, said plate means being formed with lock means for locking the gate rod means, whereby with movement of the handle means, the elongated rod means rotates and in turn moves the plate means and the lock means while the spring means extends, whereby the lock means releases the gate rod means from the latch means.

6. The gate latch of claim 1, further comprising means for pivotally mounting said plate means.

7. The gate latch of claim 1, said spring means comprising a first end and an oppositely disposed second end, means for connecting said spring means first end to said plate means and means for connecting said spring means second end to said post.

8. The gate latch of claim 1, said elongated rod means being formed of rigid metal construction.

9. The gate latch of claim 1, means for movably linking said handle means and said plate means and being operably connected to said handle means and plate means, so that said means for movably linking said handle means is movable relative to the handle means and the plate means with movement of the handle means.

10. The gate latch of claim 9, said means for movably linking said handle means comprising a connecting rod said connecting rod comprising links formed at opposite ends of the connecting rod, one of said links movably engages said handle means and the other of said loops movably engages said plate means.

11. The gate latch of claim 1, said plate means being formed with a cam surface for slidably engaging said rod means, whereby in closing the gate, the rod means engages the cam surface thereby causing said spring means to extend.

12. A gate latch comprising in combination; latch means for locking a gate, a fixedly disposed post, and a gate movably disposed to said post, and means for mounting said latch means to the post, rod means for locking in the latch means, means for mounting the rod means on said gate, said latch means comprising means for slidably receiving said rod means, and means for releasably locking the rod means in the latch means, so that with movement of the gate towards the post the rod means is slidably received and locked in the latch means, comprising, elongated rod means for actuating the means for releasably locking the rod means, and handle means for actuating the elongated rod means, said elongated rod means being formed with means for attaching the handle means to the elongated rod means, means for adjusting the size of the elongated rod means to accommodate the post before attaching the handle means, said post being formed with a drilled through hole to slidably receive the elongated rod means, and said elongated rod means being rotatably disposed in said post hole, and said handle means being disposed at one end of the post hole and the means for releasably locking the latch means being disposed at the other end of the post hole, said means for adjusting the size of the elongated rod means comprising said elongated rod means being formed with a plurality of spaced holes, said means for attaching the handle means comprising said handle means being formed with a hole similarly sized to the spaced holes, and bolt means sized to be received in said handle hole and one of said elongated rod means holes, and said rotatably disposed elongated rod means comprising sleeve means for slidably rotatably receiving said elongated rod means and said sleeve means being retained in the post hole, whereby with movement of the handle means the elongated rod means rotates actuating the latch means to release the rod means to unlock the gate.

13. The gate latch of claim 12, said elongated rod means comprising a first portion and a second portion perpendicularly disposed to the first portion, and said handle means being disposed in said first portion, and said second portion being disposed in said sleeve means.

14. The gate latch of claim 12, said handle means being formed as an L-shaped handle and said elongated rod means being formed as an L-shape, and wherein one leg of said handle L-shape means is connected to one leg of the elongated rod means L-shape, said plurality of holes being formed in the said one leg of the elongated rod means.

15. The gate latch of claim 14, said means to adjust the size of the elongated rod means further comprising means to permit a user to cut off part of the said one leg of the elongated rod means so that at a portion of said one leg extends outwardly from the post so that at least one elongated rod means holes is outside the post for mounting the handle means.

16. The gate latch of claim 15, said elongated rod means holes being threaded.

* * * * *